US010561562B1

(12) United States Patent
Erb

(10) Patent No.: US 10,561,562 B1
(45) Date of Patent: Feb. 18, 2020

(54) AUTOMATED PHYSICAL THERAPY SYSTEM

(71) Applicant: Mark Erb, Menomonie, WI (US)

(72) Inventor: Mark Erb, Menomonie, WI (US)

( * ) Notice: Subject to any disclaimer, the term of this patent is extended or adjusted under 35 U.S.C. 154(b) by 851 days.

(21) Appl. No.: 15/217,037

(22) Filed: Jul. 22, 2016

Related U.S. Application Data

(63) Continuation of application No. 14/045,328, filed on Oct. 3, 2013, now abandoned, and a continuation-in-part of application No. 13/915,869, filed on Jun. 12, 2013, now abandoned, which is a continuation-in-part of application No. 13/088,149, filed on Apr. 15, 2011, now Pat. No. 8,485,994.

(60) Provisional application No. 61/325,170, filed on Apr. 16, 2010.

(51) Int. Cl.

| | |
|---|---|
| ***A61H 1/02*** | (2006.01) |
| ***A63B 24/00*** | (2006.01) |
| ***A63B 22/04*** | (2006.01) |
| ***A63B 22/06*** | (2006.01) |
| ***A63B 23/035*** | (2006.01) |
| ***A63B 23/04*** | (2006.01) |

(52) U.S. Cl.
CPC ..... *A61H 1/0262* (2013.01); *A63B 22/04* (2013.01); *A63B 22/0605* (2013.01); *A63B 23/03525* (2013.01); *A63B 23/0405* (2013.01); *A63B 23/0476* (2013.01); *A63B 24/0087* (2013.01); *A63B 2022/0652* (2013.01)

(58) Field of Classification Search
CPC ..... A61H 1/0262; A63B 23/0405; A63B 23/0476; A63B 22/04; A63B 22/0605
See application file for complete search history.

(56) References Cited

U.S. PATENT DOCUMENTS

| | | | | |
|---|---|---|---|---|
| 1,098,326 A | | 5/1914 | Koch | |
| 2,598,204 A | | 5/1952 | Allen | |
| 2,893,380 A | * | 7/1959 | Walker | A61H 1/02 601/24 |
| 3,060,926 A | | 10/1962 | May | |
| 3,071,130 A | | 1/1963 | Hoyer | |
| 3,450,132 A | | 6/1969 | Ragon | |
| D237,654 S | | 11/1975 | Agatani | |
| 4,566,440 A | | 1/1986 | Berner et al. | |
| 4,586,493 A | | 5/1986 | Goodman | |
| 4,628,909 A | | 12/1986 | Tietsworth | |
| 4,986,261 A | | 1/1991 | Iams et al. | |
| 5,207,216 A | | 5/1993 | Sweeny | |

(Continued)

*Primary Examiner* — Timothy A Stanis

(57) ABSTRACT

An automated physical therapy system comprising two leg components, each of said leg components optionally moving alternatively above and below a base plane, thereby simulating a swimming motion in the legs of a user. The system provides a unique hemodynamic effect, i.e. blood from one of the user's legs above the base plane is displaced by gravity into the rest of the body, while blood from the user's other leg disposed below the base plane is displaced in that leg by gravity. Said hemodynamic effect is advantageous because the net hemodynamic effect is zero, i.e. blood displaced into the rest of the user's body is roughly equivalent to blood displaced into the user's other leg, allowing use of the system by users who are at risk if a large amount of blood is displaced in the user's heart or other internal organs.

1 Claim, 5 Drawing Sheets

(56) References Cited

U.S. PATENT DOCUMENTS

| | | | | |
|---|---|---|---|---|
| 5,258,019 | A * | 11/1993 | Riddle | A61H 1/0292 601/24 |
| 5,376,060 | A | 12/1994 | Murray | |
| 6,402,775 | B1 | 6/2002 | Bieberich | |
| 6,821,288 | B2 | 11/2004 | Schaeffer | |
| 2005/0159683 | A1 | 7/2005 | Kuo | |
| 2005/0251067 | A1 | 11/2005 | Terry | |
| 2005/0273022 | A1 | 12/2005 | Diaz et al. | |
| 2006/0112490 | A1 | 6/2006 | Chausse | |
| 2006/0211957 | A1 | 9/2006 | Beny et al. | |
| 2009/0098984 | A1 * | 4/2009 | Smyrk | A61H 1/0244 482/72 |
| 2010/0113233 | A1 * | 5/2010 | Chen | A61H 1/0292 482/133 |

* cited by examiner

AUTOMATED PHYSICAL THERAPY SYSTEM

CROSS REFERENCE

This application is a continuation-in-part and claims benefit of U.S. patent application Ser. No. 14/045,328 filed Oct. 3, 2013, which is a continuation-in-part and claims benefit of U.S. patent application Ser. No. 13/915,869 filed Jun. 12, 2013, which is a continuation-in-part and claims benefit of U.S. patent application Ser. No. 13/088,149 filed Apr. 15, 2011, now U.S. Pat. No. 8,485,994, which is a non-provisional and claims benefit of U.S. Provisional Patent Application 61/325,170 filed Apr. 16, 2010, the specification(s) of which is/are incorporated herein in their entirety by reference.

This application is a continuation-in-part and claims benefit of U.S. patent application Ser. No. 13/915,869 filed Jun. 12, 2013, which is a continuation-in-part and claims benefit of U.S. patent application Ser. No. 13/088,149 filed Apr. 15, 2011, now U.S. Pat. No. 8,485,994, which is a non-provisional and claims benefit of U.S. Provisional Patent Application 61/325,170 filed Apr. 16, 2010, the specification(s) of which is/are incorporated herein in their entirety by reference.

FIELD OF THE INVENTION

The present invention relates to devices used for physical therapy, more particularly to a system comprising a first leg component and a second leg component that simulates a swimming movement in the user's legs.

BACKGROUND OF THE INVENTION

Many individuals who have suffered injuries require physical therapy to aid their recovery. Devices have been invented that simulate activities such as simple movements, walking, and the like. The present invention features a physical therapy system providing range of motion exercise for the legs of a user that simulates swimming. When the system is activated, the leg components move the user's legs upwardly and downwardly, mimicking swimming movements. The system of the present invention can provide users with increased mobility and enhanced circulation. The system may be useful for individuals recovering from an injury, individuals who are overweight, or individual with diabetes. The system may also be used for exercises to provide core stabilization, back and hip extension, and improve back strength.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a motorized physical therapy table that exercises the user's legs by simulating a swimming motion.

One of the unique and inventive technical features of the present invention is that it allows for one of the user's legs to be positioned above the plane of the table while another of the user's legs is positioned below the plane of the table. Without wishing to limit the invention to any theory or mechanism, it is believed that the technical feature of the present invention provides for an advantageous hemodynamic effect. Specifically, this advantageous hemodynamic effect not present in the prior art is as follows: because a large portion of the human body's blood is located in the legs, lifting both legs above the plane of the table, or one leg above the plane of the table while the other remains parallel to and supported by the table may result in too much blood flow to the heart, brain, and other internal organs as gravity pulls said blood out of the legs and into the rest of the body of a user of a physical therapy table. In particular, because one leg of a user of the present invention may be disposed above the plane of the table while the other leg is disposed below the plane of the table, the net hemodynamic effect is approximately zero. This is particularly important in users with certain medical conditions that would prohibit excess blood flow to the heart and internal organs, e.g. heart disease and COPD. None of the presently known prior references or work has the unique inventive technical feature of the present invention.

BRIEF DESCRIPTION OF THE DRAWINGS

The features and advantages of the present invention will become apparent from a consideration of the following detailed description presented in connection with the accompanying drawings in which.

DESCRIPTION OF PREFERRED EMBODIMENTS

Figure 1:
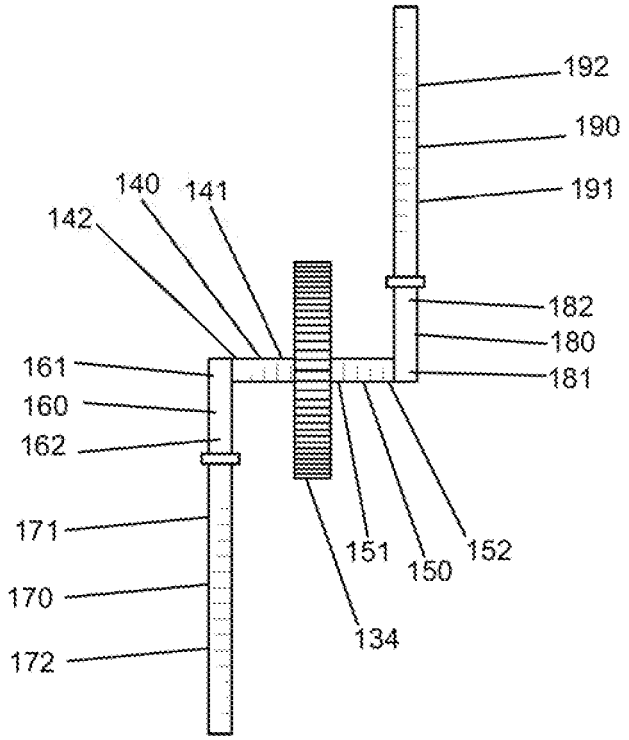
FIG. 1 shows a portion of the drive mechanism of the present invention.

Following is a list of elements corresponding to a particular element referred to herein:

100 Automated physical therapy system
110 Base
111 Base anterior side
112 Base posterior side
113 Base first side
114 Base second side
115 Base top surface
116 Base plane
117 Structural frame
120 Control panel
130 Drive system
131 Power supply
132 Motor
133 First disk
134 Second disk
135 Belt
140 First axle
141 First axle proximal end
142 First axle distal end

Figure 2:
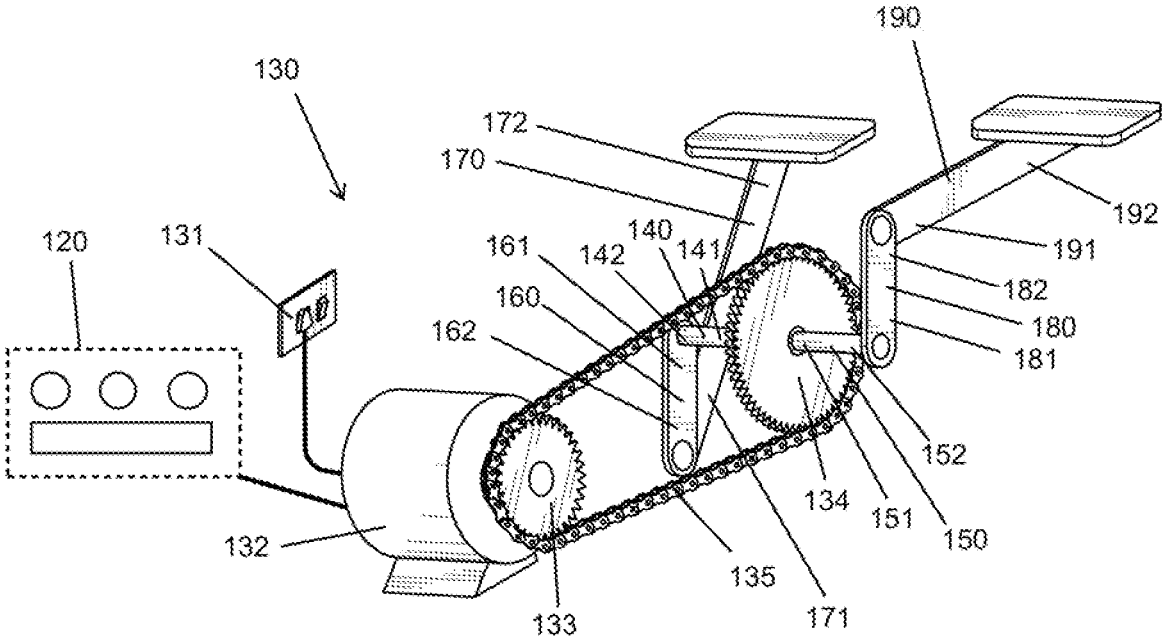
FIG. 2 shows the drive mechanism of the present invention.
Figure 3:
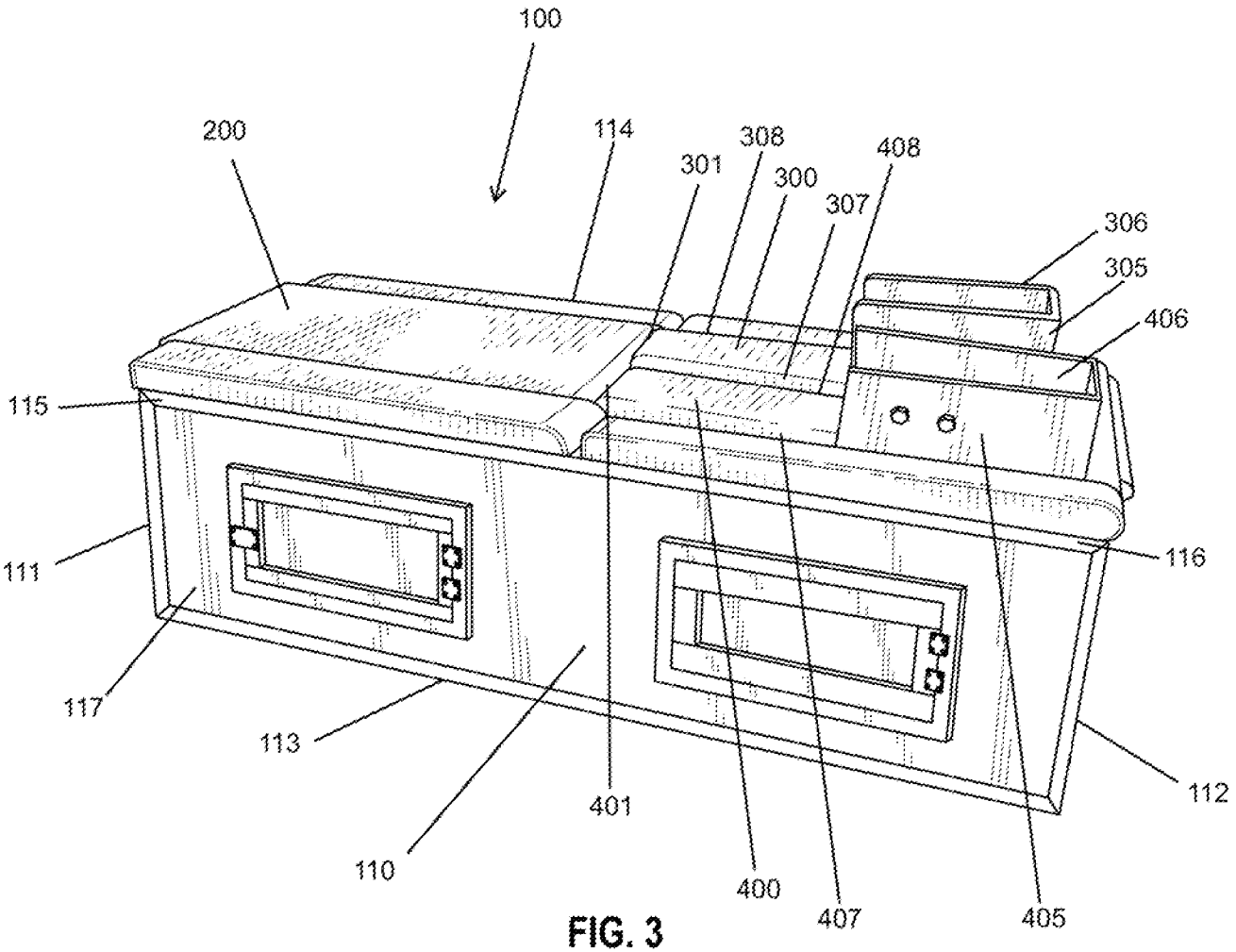
FIG. 3 shows a side perspective view of the exterior of the present invention.
Figure 4:
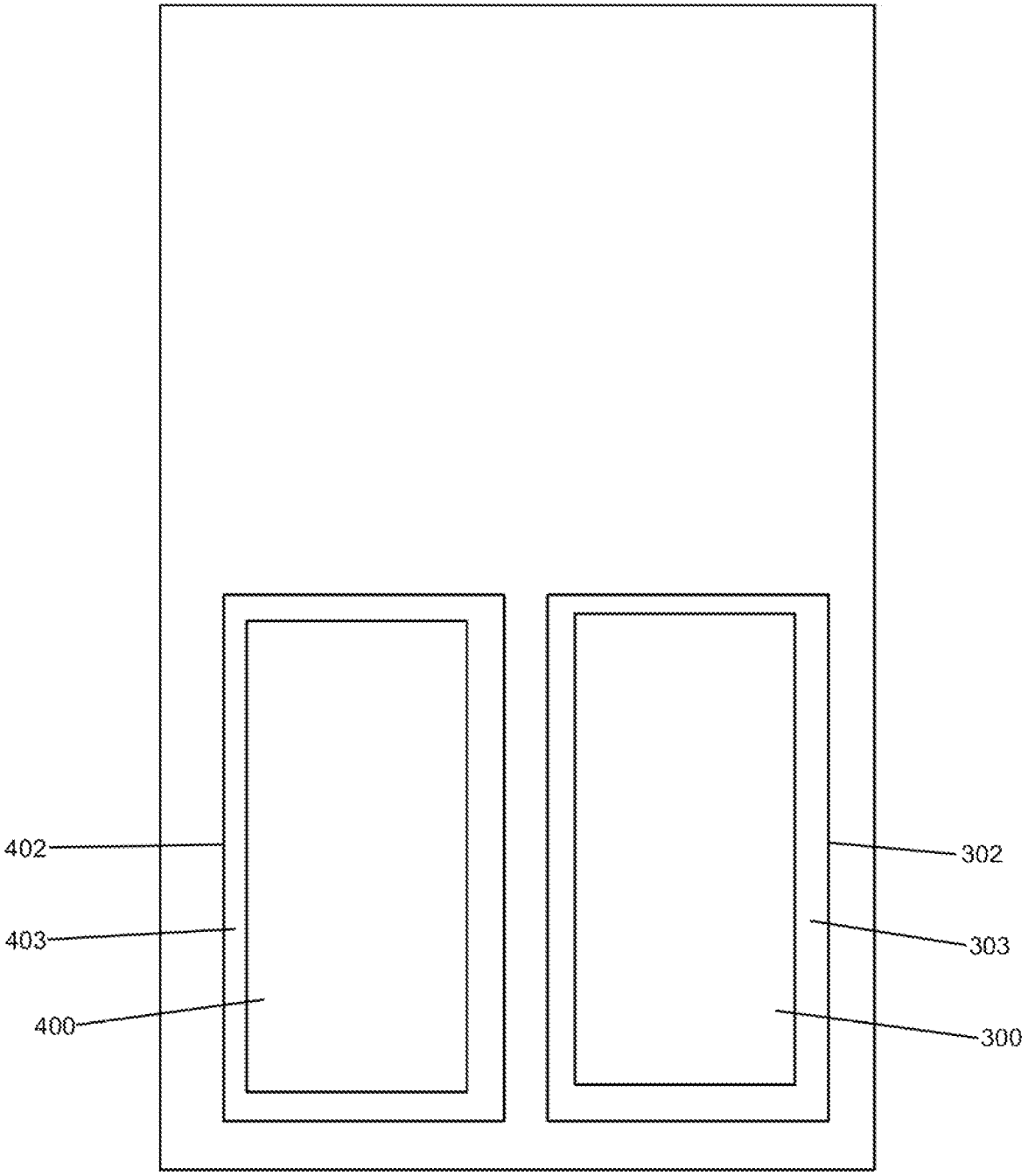
FIG. 4 shows a simplified top view diagram of the present invention.
Figure 5:
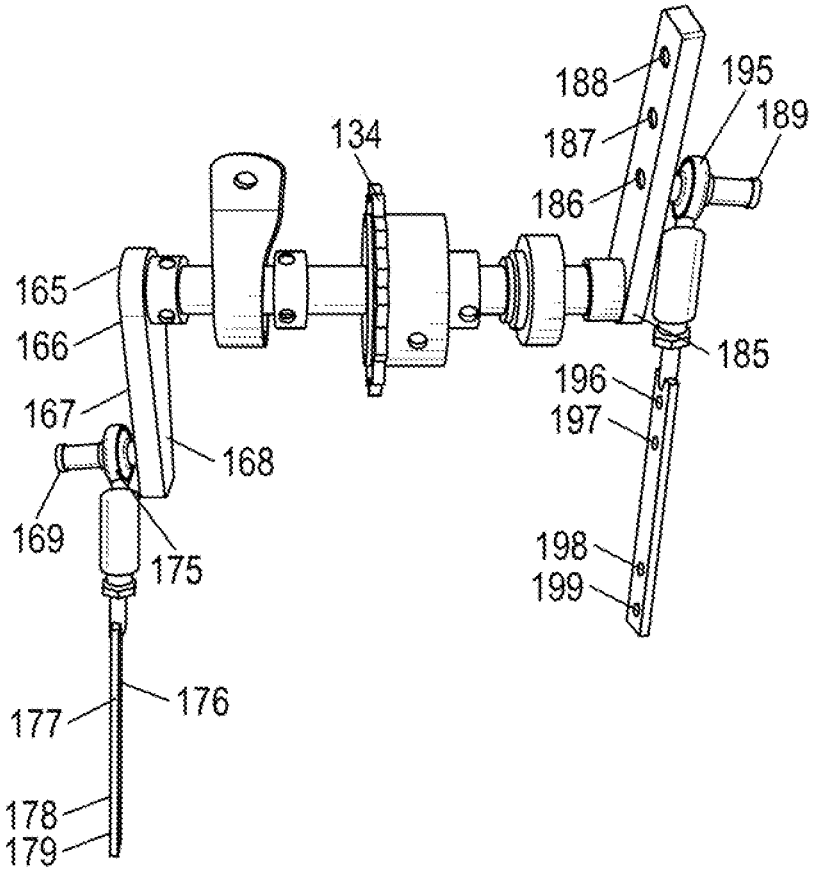
FIG. 5 shows a top view of a portion of the drive mechanism of the present invention.
Figure 6:
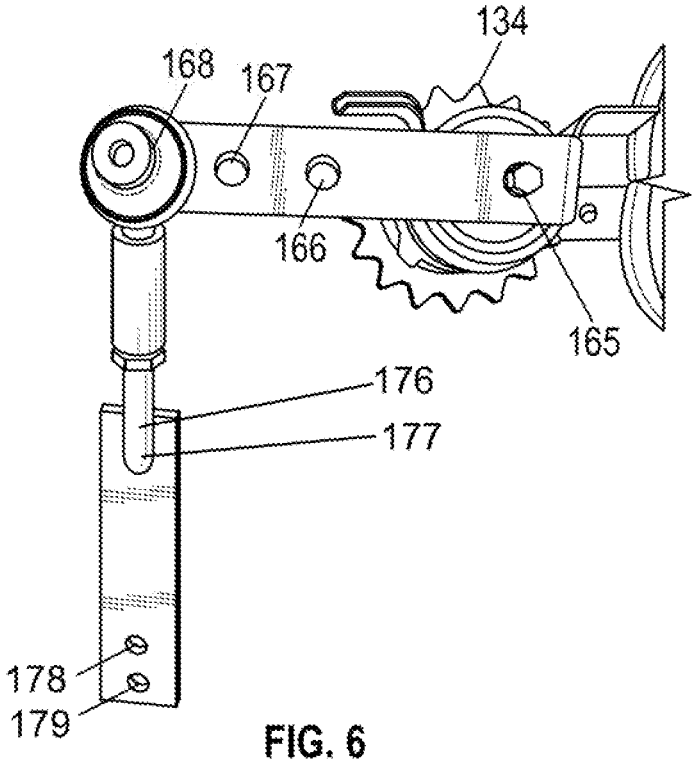
FIG. 6 shows a side view of a portion of the drive mechanism of the present invention.
Figure 7:
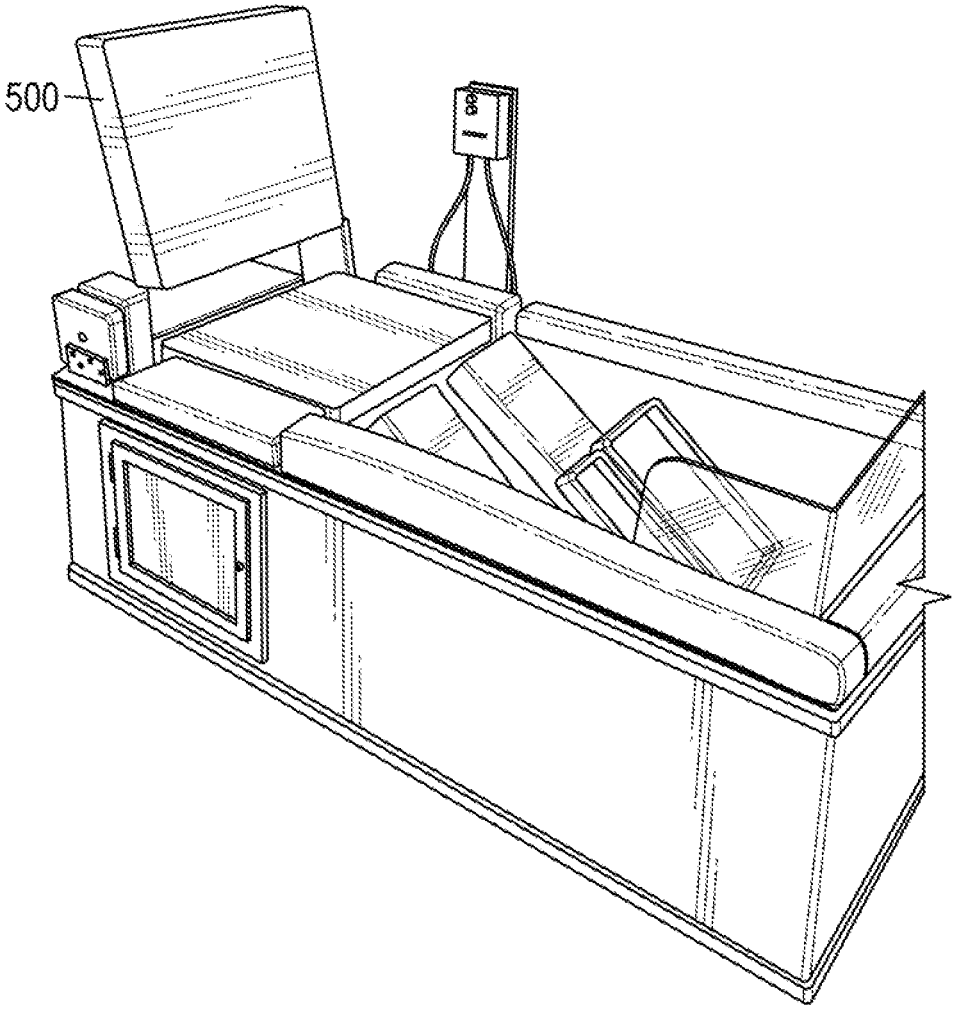
FIG. 7 is an embodiment of the present invention.

150 Second axle
151 Second axle proximal end
152 Second axle distal end
160 First connecting plate
161 First connecting plate proximal end
162 First connecting plate distal end
165 First connecting plate first aperture
166 First connecting plate second aperture
167 First connecting plate third aperture
168 First connecting plate fourth aperture
169 First connecting plate pin
170 First leg movement arm
171 First leg movement arm proximal end
172 First leg movement arm distal end
175 First leg movement arm first aperture
176 First leg movement arm second aperture
177 First leg movement arm third aperture
178 First leg movement arm fourth aperture
179 First leg movement arm fifth aperture
180 Second connecting plate
181 Second connecting plate proximal end
182 Second connecting plate distal end
185 Second connecting plate first aperture
186 Second connecting plate second aperture
187 Second connecting plate third aperture
188 Second connecting plate fourth aperture
189 Second connecting plate pin
190 Second leg movement arm
191 Second leg movement arm proximal end
192 Second leg movement arm distal end
195 Second leg movement arm first aperture
196 Second leg movement arm second aperture
197 Second leg movement arm third aperture
198 Second leg movement arm fourth aperture
199 Second leg movement arm fifth aperture
200 Back component
300 First leg component
301 First leg component hinge
302 First leg component cut-out
303 First leg component cavity
305 First leg component first leg guard
306 First leg component second leg guard
307 First leg component first side
308 First leg component second side
400 Second leg component
401 Second leg component hinge
402 Second leg component cut-out
403 Second leg component cavity
405 Second leg component first leg guard
406 Second leg component second leg guard
407 Second leg component first side
408 Second leg component second side
500 Back support component Referring now to FIG. 1-7 in some embodiments the present invention features an automated physical therapy system (100) providing range of motion exercise for the legs of a user, wherein the system (100) comprises a base (110) having a base anterior side (111), a base posterior side (112), a base first side (113), a base second side (114), and a base top surface (115), wherein the base top surface (115) lies on a base plane (116), wherein a structural frame (117) is disposed inside the base (110). In some embodiments, the base (110) comprises the general shape of a rectangular prism.

In some embodiments the present invention comprises a control panel (120). In some embodiments the control panel may be used to control the speed at which the leg components move, the height at which the leg components stop moving, and the total distance traveled by the leg components in a single cycle of movement of the leg components. The control panel therefore allows for what is referred to as "variable speed," "variable leg component height," and "variable leg component cycle," respectively. The combination of these variations allows for individualized treatment plans depending on the system's user's condition and treatment needs. In some embodiments the present invention further comprises a plurality of linear actuators, said linear actuators capable of providing a greater resolution of movement in terms of variable speed, variable leg component height, and variable leg component cycle.

Variable speed, variable leg component height, and variable leg component cycle allow for users of the present invention to undergo individualized treatment plans that may include the traditional four stages of physical therapy rehabilitation. The first traditional stage of physical therapy rehabilitation is slow, short movements. The second traditional stage of physical therapy rehabilitation is fast, short movements. The third traditional stage of physical therapy rehabilitation is slow, long movements. The fourth and final traditional stage of physical therapy rehabilitation is fast, long movements. Advantageously, the present invention allows a user to undergo any or all of the four traditional stages of physical therapy rehabilitation due to the present invention's variable speed, variable leg component height, and variable leg component cycle abilities.

In some embodiments the present invention comprises a drive system (130) disposed on the structural frame (117) underneath the base top surface (115). In some embodiments, said drive system (130) comprises a power supply (131) disposed proximal to the base anterior side (111), said power supply (131) operatively connected to a motor (132), said motor (132) operatively connected to a first disk (133), said first disk (133) operatively connected to a second disk (134). In some embodiments, said first disk (133) is operatively connected to said second disk (134) by a belt (135), said belt (135) being operatively looped around said first disk (133) and said second disk (134). In some embodiments, said second disk (134) is rotatably disposed on a first axle (140) at a first axle proximal end (141) and a second axle (150) at a second axle proximal end (151), said first axle (140) further comprising a first axle distal end (142), said second axle (150) further comprising a second axle distal end (152).

In some embodiments, said first axle distal end (142) is connected to a first connecting plate (160) at a first connecting plate proximal end (161). In some embodiments, said first connecting plate (160) is rotatably connected to a first leg movement arm (170) at a first connecting plate distal end (162) and a first leg movement arm proximal end (171). In some embodiments, said first leg movement arm (170) further comprises a first leg movement arm distal end (172). In some embodiments, said first leg movement arm (170) further comprises a first leg movement arm first aperture (175), a first leg movement arm second aperture (176), a first leg movement arm third aperture (177), a first leg movement arm fourth aperture (178), and a first leg movement arm fifth aperture (179).

In some embodiments, said second axle distal end (152) is connected to a second connecting plate (180) at a second connecting plate proximal end (181). In some embodiments, said second connecting plate (180) is rotatably connected to a second leg movement arm (190) at a second connecting plate distal end (182) and a second leg movement arm proximal end (191), said second leg movement arm (190)

further comprising a second leg movement arm distal end (192). In some embodiments, said second leg movement arm (190) further comprises a second leg movement arm first aperture (195), a second leg movement arm second aperture (196), a second leg movement arm third aperture (197), a second leg movement arm fourth aperture (198), and a second leg movement arm fifth aperture (199).

In some embodiments, a back component (200) is pivotally disposed on the base top surface (115).

In some embodiments, the present invention comprises a first leg component (300), said first leg component (300) being pivotally attached to the base top surface (115) proximal to the base second side (114) via a first leg component hinge (301), wherein the first leg component (300) is connected to and positionably disposed on the first leg movement arm distal end (172).

In some embodiments, the present invention comprises a second leg component (400), said second leg component (400) being pivotally attached to the base top surface (115) proximal to the base first side (113) via a second leg component hinge (401), wherein the second leg component (400) is connected to and positionably disposed on the second leg movement arm distal end (192).

In some embodiments the present invention comprises a first leg component cut-out (302), said first leg component cut-out (302) disposed proximal to a first leg component cavity (303) extending into the base (110) from the base top surface (115), said first leg component cavity (303) allowing said first leg component (300) to extend both above the base plane (116), away from the earth, and below the base plane (116), towards the earth. In some embodiments the present invention comprises a second leg component cut-out (402), said second leg component cut-out (402) disposed proximal to a second leg component cavity (403) extending into the base (110) from the base top surface (115), said second leg component cavity (403) allowing said second leg component (400) to extend both above the base plane (116), away from the earth, and below the base plane (116), towards the earth. In some embodiments, the first leg component (300) and the second leg component (400) are designed to receive a leg of a user, In some embodiments, the present invention allows one of the user's legs to be disposed above the base plane (116) while the user's other leg may be disposed below the base plane (116), thereby providing a unique hemodynamic effect i.e. a net displacement of blood from and to the user's legs of zero, as gravity pulls an equal amount of blood into one of the user's legs below the plane of the table while an equal amount of blood is pulled by gravity into the rest of the user's body from one of the user's legs above the plane of the table.

In some embodiments, the present invention comprises a first leg component first leg guard (305), a first leg component second leg guard (306), a second leg component first leg guard (405), and a second leg component second leg guard (406). In some embodiments, said first leg component first leg guard (305) is disposed on a first leg component first side (307), said first leg component second leg guard (306) disposed on a first leg component second side (308), said second leg component first leg guard (405) disposed on a second leg component first side (407), and said second leg component second leg guard (406) disposed on a second leg component second side (408). In some embodiments, said first leg component first leg guard (305) and said first leg component second leg guard (306) prevent a user's leg from being caught in between the plane of the table and the first leg component (300). In some embodiments, said second leg component first leg guard (405) and said second leg component second leg guard (406) prevent a user's leg from being caught in between the plane of the table and the second leg component (400).

In some embodiments, the first connecting plate (160) has a first connecting plate first aperture (165), a first connecting plate second aperture (166), a first connecting plate third aperture (167), and a first connecting plate fourth aperture (168). In some embodiments, the second connecting plate (180) has a second connecting plate first aperture (185), a second connecting plate second aperture (186), a second connecting plate third aperture (187), and a second connecting plate fourth aperture (188). Said apertures of the first connecting plate (160) and second connecting plate (180) allow for variable paddle cycle, variable paddle cycle being defined as the ability of the first leg component (300) and second component (400) to be displaced at varying heights above the base plane (116) of the present invention and varying heights below the base plane (116) of the present invention. Said height can be adjusted by moving the first connecting plate pin (169) to different apertures in the first connecting plate (160) or by moving the second connecting plate pin (189) to different apertures in the second connecting plate (180). Connecting the first connecting plate pin (169) to the first connecting plate first aperture (165) or the second connecting plate pin (189) to the second connecting plate first aperture (185) results in a paddle cycle of 0; that is the first leg component (300) or the second leg component (400) will not move at all. This is particularly advantageous in users with injuries to one leg or other conditions that would prevent movement of one of the user's legs but not the other. In these circumstances, the present invention allows one of the user's legs to be exercised while the other remains stationary, which results in what is referred to herein as "nerve cross-talk." Nerve cross-talk is a result of the fact that nerves from one side of the user's body, i.e. those nerves from the right side of the user's body "cross-talk" with nerves on the left side of the user's body. A further advantage of the present invention is that it puts no weight on the user's joints and provides smooth, non-jarring motion, reducing stress on the user's joints compared to traditional methods of exercise, which may be particularly advantageous for users with arthritic conditions and users with balance problems.

Without wishing to limit the present invention to any particular theory or mechanism, in some embodiments the paddle cycle is 2 inches * X , where X=the number of apertures away from the first connecting plate first aperture (165) and the second connecting plate first aperture (185) in which the first connecting plate pin (169) or second connecting plate pin (189) is placed, respectively. For example, if the first connecting plate pin (169) is placed in the first connecting plate second aperture (166) and the second connecting plate pin (189) is placed in the second connecting plate second aperture (186) then the paddle cycle would be two inches, and so on. By adjusting the position of the apertures on the first connecting plate (160) and second connecting plate (180), the paddle cycle can therefore also be adjusted. In a similar manner, paddle height may also be adjusted by selecting which aperture on the first leg movement arm (170) or second leg movement arm (190) the first connecting plate pin (169) and second connecting plate pin (189) attaches the first connecting plate (160) to the first leg movement arm (170) and the second connecting plate pin (189) attaches the second leg movement arm (190) to the second connecting plate (180).

In some embodiments the present invention further comprises a back support component (500), said back support component providing support for the back of a user and thereby allow a user to use the present invention in a seated, rather than supine or prone, position. The ability to use the present invention in a seated position is advantageous for users that may find it uncomfortable to adopt a prone or supine position, e.g. users with kyphosis, certain arthritic conditions, etc.

In some embodiments, for operation, the first leg component (300) and the second leg component (400) each pivotally move to provide range of motion exercise for the legs of a user via operation of the control panel (120), and the drive system (130);

In some embodiments, the first connecting plate distal end (162) and the second connecting plate distal end (182) point in opposite directions. By pointing in opposite directions, said first connecting plate distal end (162) and said second connecting plate distal end (182) move said first leg movement arm (170) and said second leg movement arm (190) such that said first leg component (300) is disposed above said base plane (116) while said second leg component (400) is disposed below said base plane (116), or vice versa.

In some embodiments, said first leg component (300) and said second leg component (400) have a variable paddle cycle provided for by and defined as the ability of the first leg component (300) to be disposed above the base plane (116) while the second leg component (400) is simultaneously disposed below the base plane (116), and vice versa.

In some embodiments, the ability to have a variable paddle cycle provides for a hemodynamic effect in that the blood from one of the user's legs may be displaced into the rest of the user's body by virtue of the fact that that leg is disposed above the base plane (116) and thus pulled by gravity into the rest of the user's body, while the blood from the other of the user's legs may be displaced into that other leg by virtue of the fact that that leg is disposed below the base plane (116) and thus blood is pulled by gravity into that leg.

In some embodiments, the ability of the first leg component (300) and the second leg component (400) to extend into the base (110) from the base top surface (115) provides for the ability to stretch the iliopsoas muscle bilaterally.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. An automated physical therapy system (100) providing range of motion exercise for the legs of a user, wherein the system (100) consisting of:

(a) a base (110) having a base anterior side (111), a base posterior side (112), a base first side (113), a base second side (114), and a base top surface (115), wherein the base top surface (115) lies on a base plane (116), wherein a structural frame (117) is disposed inside the base (110);

(b) a control panel (120);

(c) a drive system (130) disposed on the structural frame (117) underneath the base top surface (115), said drive system (130) consisting of a power supply (131) disposed proximal to the base anterior side (111), said power supply (131) operatively connected to a motor (132), said motor (132) operatively connected to a first disk (133), said first disk (133) operatively connected to a second disk (134) by a belt (135), said belt (135) being operatively looped around said first disk (133) and said second disk (134), said second disk (134) rotatably disposed on a first axle (140) at a first axle proximal end (141) and a second axle (150) at a second axle proximal end (151), said first axle (140) further consisting of a first axle distal end (142), said second axle (150) further consisting of a second axle distal end (152);

(d) said first axle distal end (142) connected to a first connecting plate (160) at a first connecting plate proximal end (161), said first connecting plate (160) rotatably connected to a first leg movement arm (170) at a first connecting plate distal end (162) and a first leg movement arm proximal end (171), said first leg movement arm (170) further consisting of a first leg movement arm distal end (172), wherein the first connecting plate (160) has a first connecting plate first aperture (165), a first connecting plate second aperture (166), a first connecting plate third aperture (167), and a first connecting plate fourth aperture (168), wherein said apertures of the first connecting plate (160) allows for variable paddle cycle;

wherein said first leg movement arm (170) further comprises a first leg movement arm first aperture (175), a first leg movement arm second aperture (176), a first leg movement arm third aperture (177), a first leg movement arm fourth aperture (178), and a first leg movement arm fifth aperture (179), wherein said apertures of the first leg movement arm (170) allows for variable paddle height;

(e) said second axle distal end (152) connected to a second connecting plate (180) at a second connecting plate proximal end (181), said second connecting plate (180) rotatably connected to a second leg movement arm (190) at a second connecting plate distal end (182) and a second leg movement arm proximal end (191), said second leg movement arm (190) further consisting of a second leg movement arm distal end (192), wherein the second connecting plate (180) has a second connecting plate first aperture (185), a second connecting plate second aperture (186), a second connecting plate third aperture (187), and a second connecting plate fourth aperture (188), wherein said apertures of the second connecting plate (180) allows for variable paddle cycle;

wherein said second leg movement arm (190) further comprises a second leg movement arm first aperture (195), a second leg movement arm second aperture (196), a second leg movement arm third aperture (197), a second leg movement arm fourth aperture (198), and a second leg movement arm fifth aperture (199), wherein said apertures of the second leg movement arm (190) allows for variable paddle height;

(f) a first leg component (300), said first leg component (300) being pivotally attached to the base top surface (115) proximal to the base second side (114) via a first leg component hinge (301), wherein the first leg component (300) is connected to and positionably disposed on the first leg movement arm distal end (172); and (g) a second leg component (400), said second leg component (400) being pivotally attached to the base top surface (115) proximal to the base first side (113) via a second leg component hinge (401), wherein the second leg component (400) is connected to and positionably disposed on the second leg movement arm distal end (192);

(h) a first leg component cut-out (302), said first leg component cut-out (302) disposed proximal to a first leg component cavity (303) extending into the base (110) from the base top surface (115), said first leg component cavity (303) allowing said first leg component (300) to extend both above the base plane (116), away from the earth, and below the base plane (116), towards the earth, and a second leg component cut-out (402), said second leg component cut-out (402) disposed proximal to a second leg component cavity (403) extending into the base (110) from the base top surface (115), said second leg component cavity (403) allowing said second leg component (400) to extend both above the base plane (116), away from the earth, and below the base plane (116), towards the earth, wherein the first leg component (300) and the second leg component (400) are designed to receive a leg of a user, thereby allowing one of the user's legs to be disposed above the base plane (116) while the user's other leg is disposed below the base plane (116);

(i) a first leg component first leg guard (305), a first leg component second leg guard (306), a second leg component first leg guard (405), and a second leg component second leg guard (406), said first leg component first leg guard (305) disposed on a first leg component first side (307), said first leg component second leg guard (306) disposed on a first leg component second side (308), said second leg component first leg guard (405) disposed on a second leg component first side (407), said second leg component second leg guard (406) disposed on a second leg component second side (408);

wherein for operation, the first leg component (300) and the second leg component (400) each pivotally move to provide range of motion exercise for the legs of a user via operation of the control panel (120), and the drive system (130);

wherein the first connecting plate distal end (162) and the second connecting plate distal end (182) point in opposite directions;

wherein said first leg component (300) and said second leg component (400) have a variable paddle cycle provided for by and defined as the ability of the first leg component (300) to be disposed above the base plane (116) while the second leg component (400) is simultaneously disposed below the base plane (116), and vice versa;

wherein the ability to have a variable paddle cycle provides for a hemodynamic effect in that the blood from one of the user's legs is displaced into the rest of the user's body by virtue of the fact that that leg is disposed above the base plane (116) while the blood from the other of the user's legs is displaced into that other leg by virtue of the fact that that leg is disposed below the base plane (116);

wherein the ability of the first leg component (300) and the second leg component (400) to extend into the base (110) from the base top surface (115) provides for the ability to stretch the iliopsoas muscle bilaterally.

* * * * *